US005173988A

United States Patent [19]

Bhatia et al.

[11] Patent Number: 5,173,988

[45] Date of Patent: Dec. 29, 1992

[54] DEWATERING APPARATUS FOR DROP MARKING BOTTLES AND CANS

[75] Inventors: Chandrakant R. Bhatia, Libertyville; Robert E. Petterec, Lake Villa, both of Ill.

[73] Assignee: Videojet Systems International, Inc., Wooddale, Ill.

[21] Appl. No.: 716,258

[22] Filed: Jun. 17, 1991

[51] Int. Cl.[5] ..... B08B 5/02

[52] U.S. Cl. ..... 15/309.2; 15/316.1; 15/345; 15/405; 239/566; 239/DIG. 21

[58] Field of Search ..... 15/309.2, 309.1, 316.1, 15/304, 306.1, 345, 405; 239/566, 587.1, DIG. 21

[56] References Cited

U.S. PATENT DOCUMENTS

| | | | |
|---|---|---|---|
| 1,728,113 | 9/1929 | Fertally | 15/405 X |
| 2,129,681 | 9/1938 | Geibig | 239/566 X |
| 3,568,238 | 3/1971 | Fischer | 15/309.2 |
| 3,678,53[illegible] | 7/1972 | Hilbig | 15/345 |
| 3,849,831 | 11/1974 | DeVerter et al. | 15/309.2 X |
| 3,939,526 | 2/1976 | Mania et al. | 15/309.2 |
| 4,167,797 | 9/1979 | Wilde et al. | 15/309.2 X |
| 4,278,711 | 7/1981 | Sullivan | 239/566 X |

*Primary Examiner*—Chris K. Moore

*Attorney, Agent, or Firm*—Rockey, Rifkin and Ryther

[57] ABSTRACT

An air knife assembly is disclosed for removing water and soapy lubricants from an area of a bottle or can which is to be labeled or coded using drop marking equipment. The air knife is positioned at the correct pitch, roll and yaw angles to remove water from a desired area only, avoiding damage to labels which have been applied but not yet bonded to the bottle or can. The dewatering ensures accurate marking of the product.

9 Claims, 3 Drawing Sheets

DWELL
BACK
LABLER
20

20
22
24
26
26
14
12

FIG.3
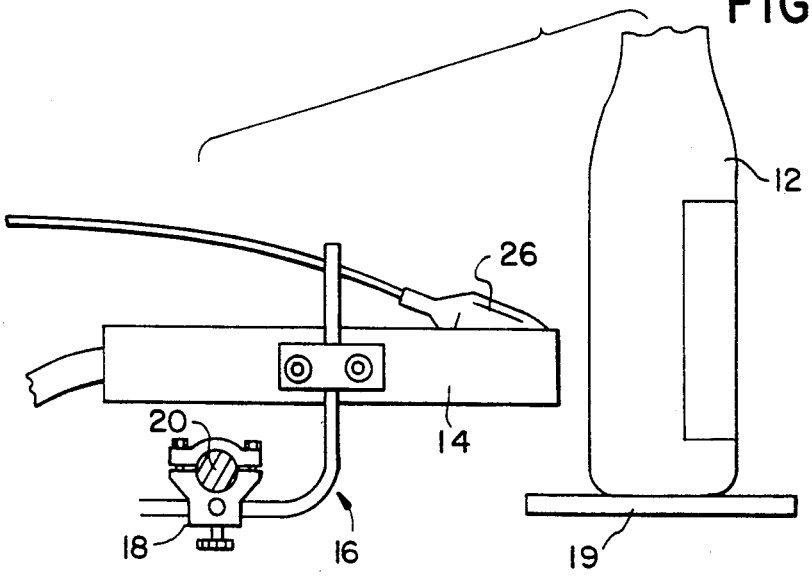
FIG.4A
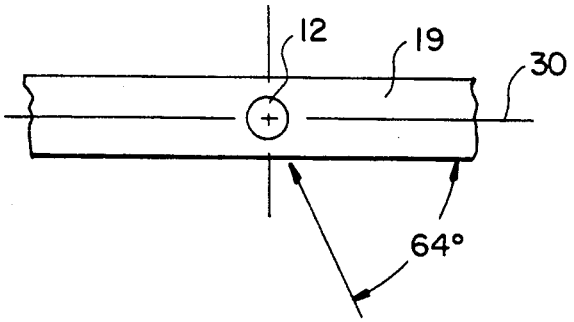
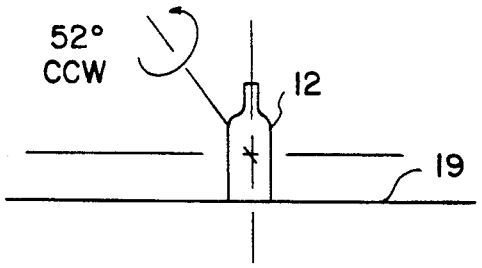
FIG.4B
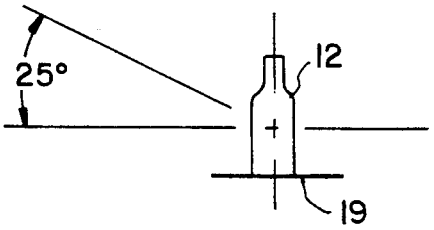
FIG.4C

DEWATERING APPARATUS FOR DROP MARKING BOTTLES AND CANS

BACKGROUND OF THE INVENTION

This invention relates to drop marking systems for products sold in cans and bottles, such as beer, soft drinks, food stuffs and the like. More specifically, it relates to an apparatus for removing water from an area to be marked just prior to the marking operation. Dewatering, as this step is commonly called in the industry, is employed to permit typical marking systems such as ink jet coders to print information on a bottle or can passing by an ink jet print head during the bottling or canning process. Such marking operations typically place important information on the product, such as date codes, lot information and similar information used to track the product for various purposes.

The present invention has particular application to the beverage industry where cans and bottles of chilled drinks, such as beer, soda and the like are placed into cans or bottles by high speed filling equipment. Shortly after the filling operation, capping and labeling operations take place followed by the marking operation to specify a date of manufacture and/or manufacturing codes. Proper coding is an important consideration if it should be necessary to trace the product to a particular assembly line or batch. It is difficult to ensure completely accurate marking of bottles and cans due mainly to the condensation which forms on the outside of the container after the addition of the cold liquid. Additional problems are encountered due to soapy type lubricants used on the product conveyors. If these liquids are not removed from the area of the container to be coded, the ink from the ink jet printer or similar drop marking device, will not adhere satisfactorily to the container.

Present efforts to solve this problem include the use of air manifolds positioned immediately adjacent the ink jet print head. Generally, such manifolds consist of a closed section of pipe connecting to an air supply. Small holes are provided along the length of the pipe. Air passes through the holes and is directed at the bottles or cans in an effort to blow off the undesired liquid. Such prior art designs use more air than necessary, are fairly noisy and still do not produce an area as clean and dry as is desired for high reliability marking of the containers.

A further problem with prior art systems is the nature of the air blast. High pressure air, if not precisely positioned can interfere with label placement and adhesion on the containers being marked. More specifically, front and back labels are often applied to the containers and the water based adhesive used requires a period of time to set. Air blasts, for purposes of dewatering, can dislodge or shift these labels.

It is accordingly an object of the present invention to provide an improved dewatering apparatus which can effectively remove moisture from the area of a container to be marked while the container is moving on a high speed beverage filling conveyor.

It is another object of the invention to provide a dewatering system which can be positioned to dewater only the area to be marked and which will avoid interfering with the adhesion of recently applied labels to the container.

A further object of the invention is to provide an apparatus employing at least one air knife to precisely direct air at the container to be marked to ensure that a clean, dry surface is presented to the marking device.

These and other objects of the invention will be apparent from the remaining portion of the specification.

BRIEF DESCRIPTION OF THE DRAWINGS

FIG. 3 is a partial side view illustrating the relationship between the marking system and the product.

FIGS. 4*a*, 4*b* and 4*c* illustrate the angles at which the present invention is preferably positioned in order to maximize performance.

DETAILED DESCRIPTION

Figure 1:
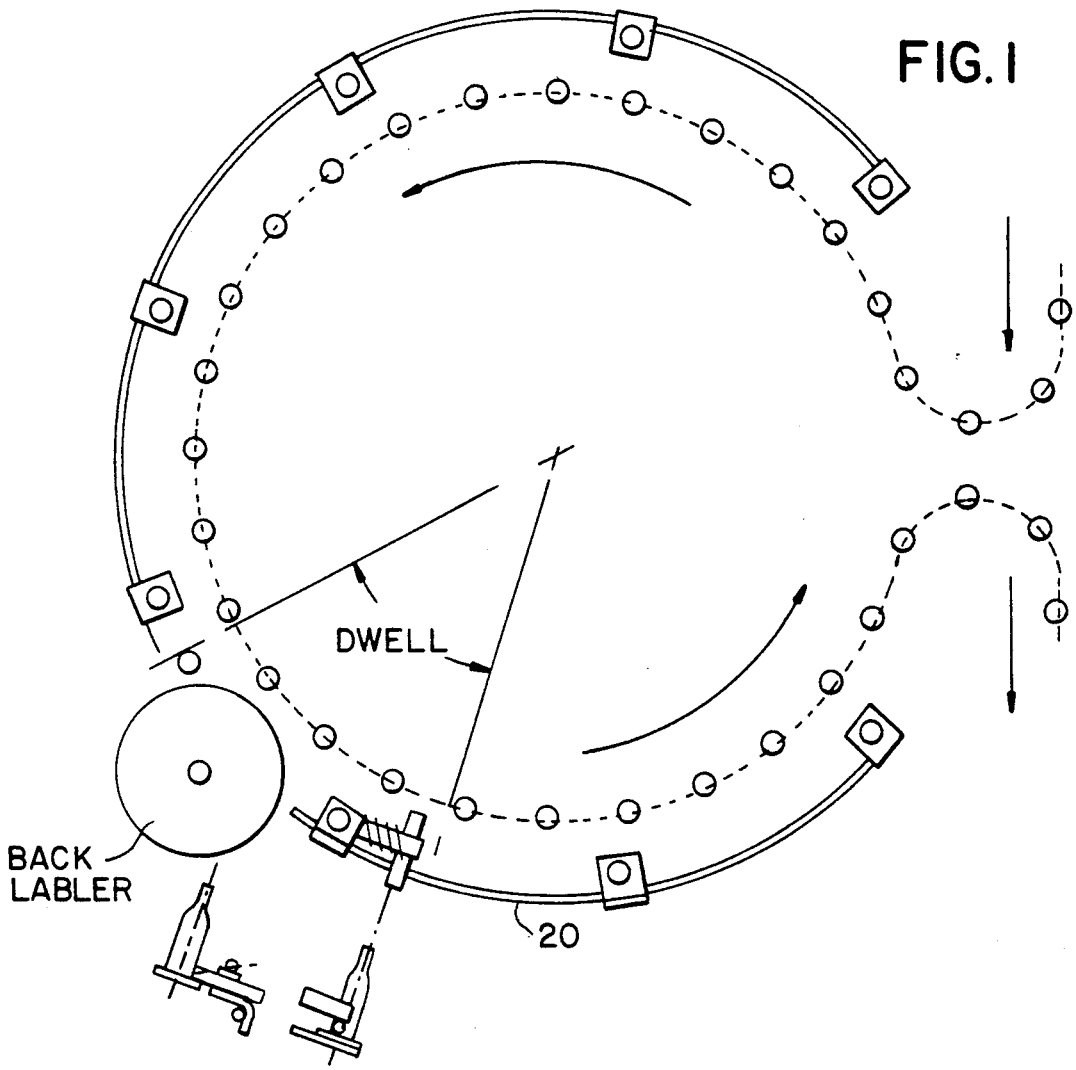
FIG. 1 is a plan view of a typical beverage bottling conveyor illustrating the environment in which the present invention is employed.

Referring to FIG. 1, there is illustrated a typical bottle conveyor suitable for use with the present invention. As is known to those skilled in this art, bottles are carried on the conveyor at high speed in the direction of the arrows past units which fill them with liquid and applies a cap or other sealing device. Next a labeling mechanism applies one or more labels and then the bottles move on to a marking station where the desired date and/or batch coding information is applied.

As indicated schematically in FIG. 1, the labeling operation occurs upstream of the ink jet marking operation. In the event that a back labeler is used to place a label on the back of the bottle, the two operations are spaced from each other by an angle indicated by "dwell" on the drawing.

After labeling and making at an ink jet station generally indicated at 10, the containers continue on the conveyor to a final station where they are packed for shipping.

Figure 2:
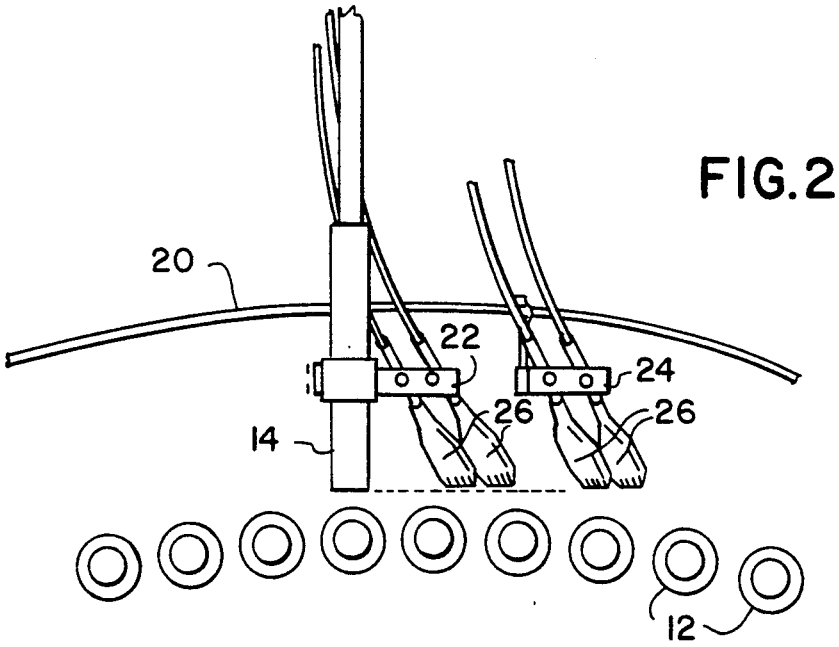
FIG. 2 is a partial plan view illustrating the physical relationship of the invention to the marking device and the containers.

Referring to FIG. 2, a plan view of the ink jet station 10, illustrating the details thereof, is provided. In the typical marking operation, the bottles 12 pass by an ink jet print head 14 positioned to print the coding information at a desired position on the bottle.

As can be seen in the side view of FIG. 3, the print head 14 is often positioned near the bottom third of the bottle, approximately 3/16" from the bottle surface. As also shown in FIG. 3, it is usual and desirable to put the coding information on the backside of the bottle opposite the front label.

In order to permit adjustment of the print head position, it is mounted to a print head holder generally indicated at 16 which includes a horizontal adjustment mechanism 18 and a vertical adjustment mechanism 20. Utilizing these adjustments, the print head can be positioned vertically at the desired height relative to the bottle which is being conveyed on a bottle pad 19, which is part of the high speed labeling system. In addition, the spacing between the bottle and print head can be controlled by the horizontal adjustment mechanism 18. The print head holder 16 is secured to the conveyor system by clamping or otherwise being affixed to a rail 20 (FIG. 2) which is part of the labeler system.

According to the present invention, an air knife assembly consisting of at least one and preferably two or more air knives are used to dewater or dry the surface are of the bottle to be marked prior to coding by the print head 14. The term air knife, as used in this specification, means a linear array of tiny openings connected to a common manifold to which air is supplied. The result is to produce a very thin line of high pressure air from the output of each knife. The thin line of air can be, as disclosed hereafter, carefully positioned with respect to pitch, roll and yaw angles to accurately strike the bottles as they pass in front of the knife to dewater an area where marking is to occur while still leaving relatively undisturbed other areas of the bottle which, for example, may contain adhesive labels which have not yet set. By utilizing a linear array of tiny nozzles to create a thin line of air pressure, and by careful positioning of the knives, water and soapy lubricants can be sheared down and away from the bottle, producing a clean area for the coding operation.

Figure 6A:
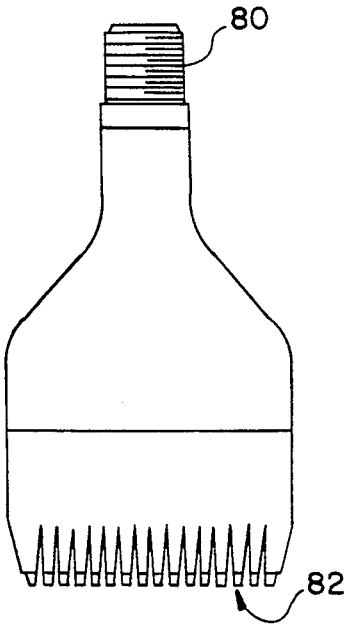
FIGS. 6*a* and 6*b* are plan and end elevational views of an air knife suitable for use in the present invention.
Figure 6B:
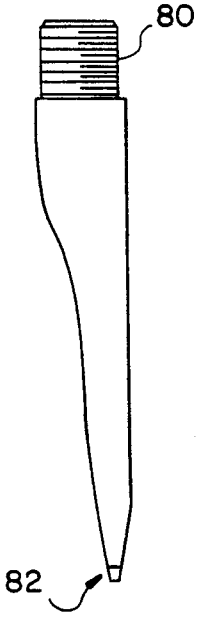

Air knives of the type required for use with the present invention are commercially available. For example, such nozzles are manufactured and sold by Lechler Incorporated, nozzle type No. 600.130. Such devices are sold under the trademark WHISPER BLAST and consist of a multichannel flat spray nozzle with a low noise level output. The nozzle utilizes a laminar air flow design. Typically there are approximately 16 openings of nozzles connected to the manifold with each opening being approximately one millimeter in diameter and spaced approximately ½ inch apart. The general configuration of this device is shown in FIGS. 6*a* and 6*b* air is supplied to the device by coupling a hose to end 80. Air exits the air knife through the linear array of openings indicated at 82.

Referring again to FIGS. 2 and 3, it can be seen that the air knives are secured to the rail 20 by means of brackets 22 and 24 or any similar fixture. The bracket 22 may be part of the print head holder assembly 16 which, as previously indicated, is connected to the rail 20. If more than two air knives are required a second bracket assembly 24, also connected to rail 20, may be provided. The air knives indicated at 26 are generally positioned upstream from the print head 14 so as to prepare the bottles prior to their reaching the print head. Depending upon the speed of the line, the number of code letters to be marked, and, therefore, the size of the area to be dewatered, one or more than one air knife may be required. In most operations two air knives will be employed. A second pair of air knives will typically be used in humid installations or during the summer when increased humidity is encountered.

In order to ensure optimal marking performance, it is necessary that the air knives be positioned within an empirically determined critical range of pitch, roll and yaw, angles, relative to the bottles to be dewatered. The correct positioning of the air knives is illustrated in FIGS. 4A, 4B and 4C.

Referring to FIG. 4A, there is illustrated a top view of the conveyor line showing the bottle pad 19 having a bottle 12 thereon. It has been found that the air knives should be positioned, relative to the longitudinal axis 30 of the conveyor, at an angle of 64 degrees plus or minus 5 degrees. Thus it will be understood that the air knives are pointing upstream of the position at which they are located, and the air emitted therefrom strikes the bottles prior to the bottles reaching the air knives.

Referring to FIG. 4C, the second critical angle is illustrated. In this end view, it can be seen that the air knives should be positioned at an angle of declination from the horizontal of 25 degrees plus or minus 5 degrees. Summarizing FIGS. 4A and 4C, it will be understood that the air knives should be pointing upstream by approximately 64 degrees, and should be angled downwardly with respect to a horizontal plane by an angle of 25 degrees plus or minus 5 degrees.

Referring to FIG. 4B, the final angular position is illustrated. FIG. 4C, which is a side view, is intended to illustrate that the linear array of openings which form the nozzle should be rotated from a position in which the openings are vertically aligned by 52 degrees plus or minus 5 degrees. The direction of this rotation would be counterclockwise in FIG. 4B, assuming that the bottles are moving toward the viewer. This orientation assures that water and lubricants are sheared downwardly on the bottle surface to produce a clean area which can be marked.

The net effect of the three angles illustrated and described in connection with FIGS. 4A, 4B and 4C, is to position the linear array so that air strikes the upper area to be marked and forces the water downwardly. As a bottle moves toward the air knives, the increasing air pressure brought to bear continues to push the liquid downwardly and off the bottle. This arrangement prevent air and/or liquid from traveling upwardly into a region which may have been utilized for a rear label. The water and/or the air, should they reach the label area, can dislodge the label if the adhesive used to secure it has not yet set. Because of the superior ability of the dewatering mechanism disclosed herein, highly reliable marking can be assured.

Figure 5:
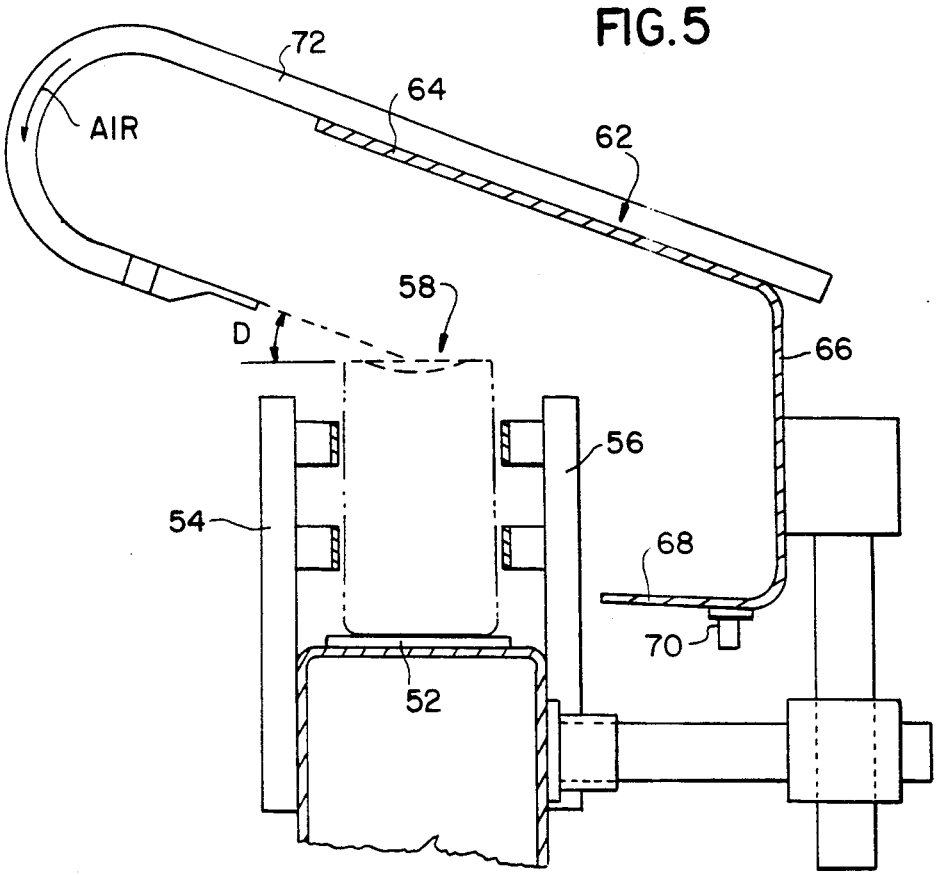
FIG. 5 is a partial end elevational view of a second embodiment of the invention for use with cans which are bottom marked.

Referring to FIG. 5, there is illustrated a second embodiment of the invention suitable for use in marking cans on a bottom portion thereof. As illustrated in FIG. 5, a high speed can conveyor line has a plurality of cans 50 conveyed on a belt 52 between supports 54 and 56. The cans at the point illustrated at FIG. 5 have been filled, sealed and inverted so that their bottoms are facing up. As with the bottles previously discussed herein, because cold liquids have been received in the cans, condensation forms on the outside thereof. Such cans, as known in this art, typically have a concave, conically shaped bottom, illustrated generally a 58 in the drawing.

In typical code marking applications, the print head is vertically positioned to mark the conical portion of the can bottom. In order to ensure highly accurate marking, it si necessary to dewater this surface. For that purpose, there is provided, according to the invention, an air knife and hood designed to capture the dispersed liquid and to drain them from marking area. Specifically, an air knife of the type previously described, is positioned as shown at 60. It is directed at the conical surface 58 to be marked. The air knife has a declination angle, D, relative to the horizontal plane of approximately 37.5° plus of minus 2.5°. This ensures that the air enters the conical recess and traverses substantially its entire surface to blow off condensation.

Because of this positioning of the air knife, the air and liquids are carried from left to right as shown in FIG. 5 into a specially shaped hood structure 62 which consists of a formed piece of metal having an upper extension 64, a vertical extension 66 and a lower extension 68. The hood 62 is designed to capture the dispersed liquids, and to drain them to a drain or collection barrel. The hood serves both as a moisture collector and safety shield to protect personnel from the air and liquids during the dewatering process. A drain opening 70 is provided. Preferably, the air line 72, which supplies air to the air knife 60, is mounted on the upper section 64 of the hood.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed:

1. An apparatus for removing liquid from a selected area of containers traveling on a moving conveyor which are to be marked by drop marking equipment, said apparatus comprising:

a. at least one nozzle assembly comprising a housing defining a linear array of small openings communicating with a common manifold;

b. means for supplying air at above atmospheric pressure to said manifold to force air through said openings to create a line of high pressure air;

c. means for positioning each of said nozzle assemblies along said conveyor, upstream of said drop marking equipment, said positioning means permitting adjustment of the angular orientation at which said line of high pressure air strikes the containers to optimize water removal in the selected area to be marked while minimizing air striking other areas of said containers.

2. The apparatus according to claim 1 wherein at least two nozzle assemblies are employed.

3. The apparatus according the to claim 1 wherein the means for positioning is a bracket to which each nozzle assembly is mounted.

4. The apparatus according to claim 1 wherein each of said nozzle assemblies is positioned:

a. at an angle of 64°±5° relative to the longitudinal axis of the conveyor to direct air upstream;

b. at an angle of declination from the horizontal of 25°±5°; and c. rotated from a position in which a line connecting said linear array of openings is vertical by 52°±5° in a direction so that the top of the array is located upstream of the bottom;

whereby the line of high pressure air emitted from each nozzle assembly shears liquid downwardly and away from the area subjected to the air blast thereby to leave such area dry and suitable for marking.

5. The apparatus according to claim 1 wherein at least one of said nozzle assemblies is positioned:

a. at an angle of 64°±5° relative to the longitudinal axis of the conveyor to direct air upstream;

b. at an angle of declination from the horizontal of 25°±5°; and c. rotated from a position in which a line connecting said linear array of openings is vertical by 52°±5° in a direction so that the top of the array is located upstream of the bottom;

whereby the line of high pressure air emitted from each nozzle assembly shear liquid downwardly and away from the area subjected to the air blast thereby to leave such area dry and suitable for marking.

6. In a drop marking system for printing information on containers carried past a marking station on a moving conveyor, said system including means for removing liquids from the containers prior to marking the improvement comprising:

a. at least one nozzle assembly comprising a housing defining a linear array of small openings communicating with a common manifold;

b. means for supplying air at above atmospheric pressure to said manifold to force air through said openings to create a line of high pressure air;

c. means for positioning each of said nozzle assemblies along said conveyor, upstream of said drop marking equipment, said positioning means permitting adjustment of the angular orientation at which said line of high pressure air strikes the containers to optimize water removal in the selected area to be marked while minimizing air striking other areas of said containers.

7. Claim 6 wherein the means for positioning is a bracket to which each nozzle assembly is mounted.

8. The apparatus according to claim 1 wherein said container is a beverage can conveyed upside down for making on the bottom thereof and further including a hood to capture the liquids as they are blown off of the can.

9. The apparatus of claim 8 wherein the nozzle assembly has a declination angle, relative to the horizontal of approximately 37.5°±2.5°.

* * * * *